US008172585B2

(12) United States Patent
Chiu et al.

(10) Patent No.: US 8,172,585 B2
(45) Date of Patent: May 8, 2012

(54) USB CONNECTOR AND CONTACT ARRAY THEREOF

(75) Inventors: Wen-Ta Chiu, Taipei Hsien (TW); Ming-Hui Yen, Taipei Hsien (TW); Yeh-Hsi Lin, Taipei Hsien (TW); Chao-Yang Hsiao, Taipei Hsien (TW); Jhih-Ming Tu, Taipei Hsien (TW); Chang-Fa Yang, Taipei Hsien (TW); Ping-Chih Chen, Taipei Hsien (TW)

(73) Assignee: Chant Sincere Co., Ltd., Taipei Hsien (TW)

( * ) Notice: Subject to any disclaimer, the term of this patent is extended or adjusted under 35 U.S.C. 154(b) by 188 days.

(21) Appl. No.: 12/622,444

(22) Filed: Nov. 20, 2009

(65) Prior Publication Data

US 2010/0159751 A1 Jun. 24, 2010

(30) Foreign Application Priority Data

Dec. 19, 2008 (TW) ..... 97149822 A

(51) Int. Cl.
*H01R 13/648* (2006.01)
*H01R 4/66* (2006.01)

(52) U.S. Cl. ..... 439/108; 439/660; 439/941

(58) Field of Classification Search ..... 439/660, 439/676, 941, 939, 108, 101, 607.01
See application file for complete search history.

(56) References Cited

U.S. PATENT DOCUMENTS 6,948,951 B2 * 9/2005 Wu et al. ..... 439/108
7,914,305 B2 * 3/2011 Amleshi et al. ..... 439/101
2009/0130873 A1 * 5/2009 He ..... 439/108

* cited by examiner

*Primary Examiner* — Javaid Nasri
(74) *Attorney, Agent, or Firm* — CKC & Partners Co., Ltd.

(57) ABSTRACT

Disclosed herein is a contact array of a universal serial bus (USB) connector including a first signal differential pair, a second signal differential pair and a third signal differential pair, wherein the second signal differential pair is disposed between the first and third signal differential pairs, and at least one power contact or ground contact is disposed between the first and second signal differential pairs, or between the second and third signal differential pairs.

20 Claims, 9 Drawing Sheets

USB CONNECTOR AND CONTACT ARRAY THEREOF

RELATED APPLICATIONS

This application claims priority to Taiwan Application Serial Number 97149822, filed Dec. 19, 2008, which is herein incorporated by reference.

BACKGROUND

1. Field of Invention

The present invention relates to an electrical connector. More particularly, the present invention relates to a universal serial bus (USB) connector.

2. Description of Related Art

Universal serial bus (USB) is one of the most popular interfaces in signal transferring among computer devices. The USB interface has upgraded from USB 1.0/1.1 specifications to a USB 2.0 specification, then further to a USB 3.0 specification. Interface upgrading usually involves increasing transferring speed and frequency up to a higher level, and the USB 3.0 connector still has to be compatible with the connector of USB 2.0 and USB 1.0/1.1 specifications. How to overcome the potential cross talks in high-speed and high-frequency signal transferring is a major issue confronted by all connector manufacturers.

SUMMARY

According one aspect of this invention, a contact array of a universal serial bus (USB) connector includes a first signal differential pair, a second signal differential pair and a third signal differential pair, wherein the second signal differential pair is disposed between the first and third signal differential pairs, and at least one power contact or ground contact is disposed between the first and second signal differential pairs, or between the second and third signal differential pairs.

According another aspect of this invention, a contact array of a universal serial bus (BUS) connector includes a plurality of contacts each comprising a middle section, a first terminal section and a second terminal section. The middle section is interconnected between the first terminal section and second terminal section. A first bent section is interconnected between the first terminal section and the middle section, and a second bent portion is interconnected between the second terminal section and the middle section. The contacts include a first signal differential pair, a second signal differential pair and a third signal differential pair, wherein the second signal differential pair is disposed between the first and third signal differential pairs, and at least one power contact or ground contact is disposed between the first and second signal differential pairs, or between the second and third signal differential pairs.

According to still another aspect of this invention, a universal serial bus (USB) connector includes a metallic housing, a dielectric base and a plurality of contacts. The dielectric base is disposed within the metallic housing and includes a plurality of grooves spaced apart from one another. Each contact is disposed respectively within the plurality of grooves. The contacts include a first signal differential pair, a second signal differential pair and a third signal differential pair, wherein the second signal differential pair is disposed between the first and third signal differential pairs, and at least one power contact or ground contact is disposed between the first and second signal differential pairs, or between the second and third signal differential pairs.

According to yet another aspect of this invention, a contact array of a universal serial bus (USB) connector includes a first signal differential pair, a second signal differential pair and a third signal differential pair. The signal differential pairs each conclude a terminal section, to which a printed circuit board is connected, wherein the terminal sections of the signal differential pairs are arranged as below. The second signal differential pair is disposed between the first and third signal differential pairs, and at least one power contact or ground contact is disposed between the first and second signal differential pairs, or between the second and third signal differential pairs.

Thus, the contact array's arrangements of the USB connector's plug or receptacle would improve signal transferring efficiency and reduce cross talks among the array contacts, which is especially important for high-speed, high-frequency signal transferring of USB 3.0 specification in connection with a printed circuit board.

It is to be understood that both the foregoing general description and the following detailed description are by examples, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE EMBODIMENTS

Figure 1:
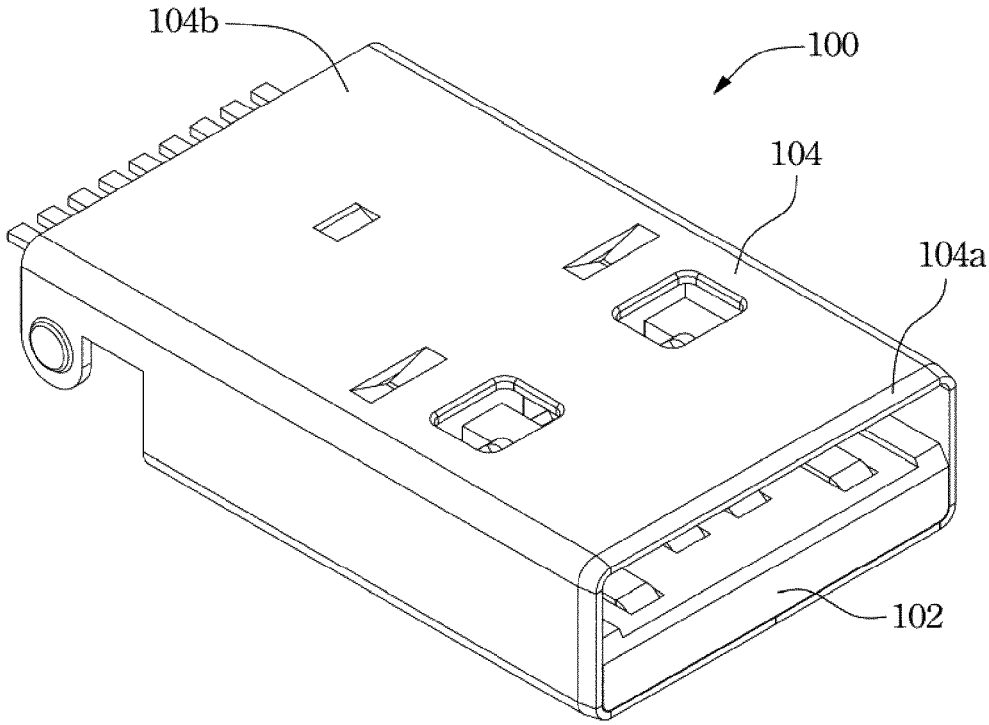
FIG. 1 illustrates a USB connector plug according to one embodiment of this invention.

Reference will now be made in detail to the present embodiments of the invention, examples of which are illustrated in the accompanying drawings. Wherever possible, the same reference numbers are used in the drawings and the description to refer to the same or like parts.

Disclosed herein is an improved universal serial bus (USB) connector with a contact array design modification in order to reduce cross talking caused by high-speed and high-frequency signal transferring.

Figure 2:
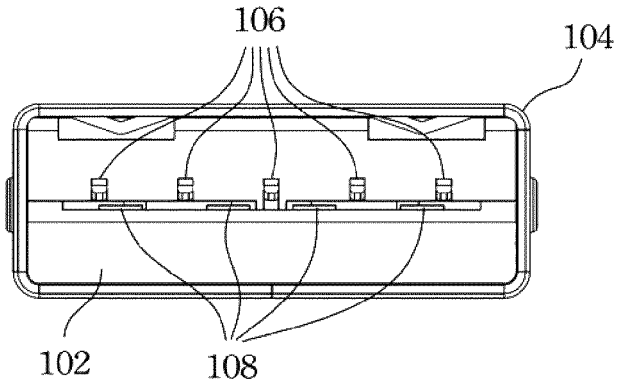
FIG. 2 illustrates a front view of the USB connector plug as illustrated in FIG. 1.

FIG. 1 illustrates a USB connector plug according to one embodiment of this invention. FIG. 2 illustrates a front view of the USB connector plug as illustrated in FIG. 1. The USB connector plug 100 includes a metallic housing 104, a dielectric base 102 and a contact array. When the metallic housing 104 is electrically to the ground, an EMI shielding is hence enabled. The contact array of the USB connector plug 100 includes a USB 2.0 contact array and a USB 3.0 contact array such that the USB connector plug 100 is compatible with a USB 2.0 connector receptacle. In particular, when a front end 104*a* of the USB connector plug 100 is inserted into the USB 2.0 connector receptacle, the USB 2.0 contact array of the USB connector plug 100 is connected with a contact array of the USB 2.0 connector receptacle. Besides, a rear end 104*b* of the USB connector plug 100 is connected with a signal cable and wrapped with insulated materials.

Figure 3:
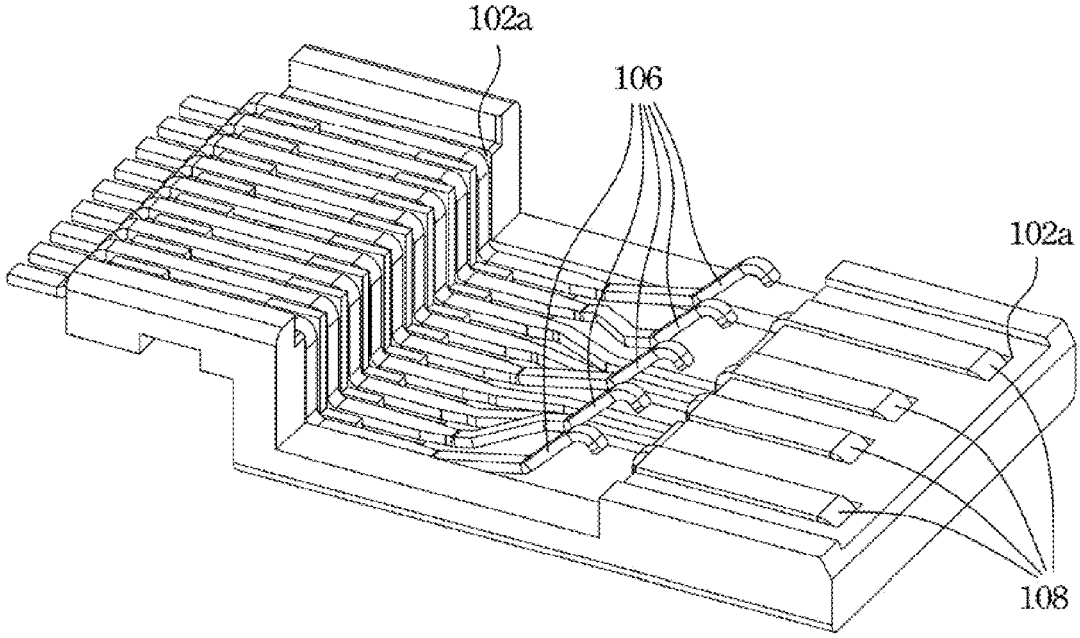
FIG. 3 illustrates the USB connector plug as illustrated in FIG. 1 with its housing removed.
Figure 4:
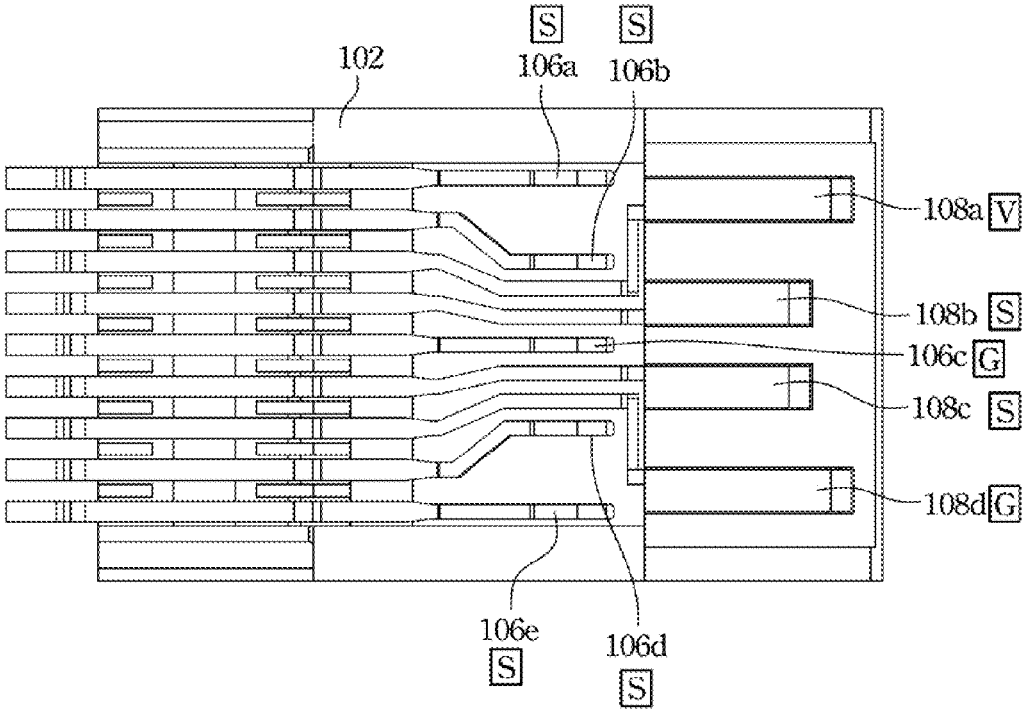
FIG. 4 illustrates a top view of the USB connector plug as illustrated in FIG. 3.
Figure 5:
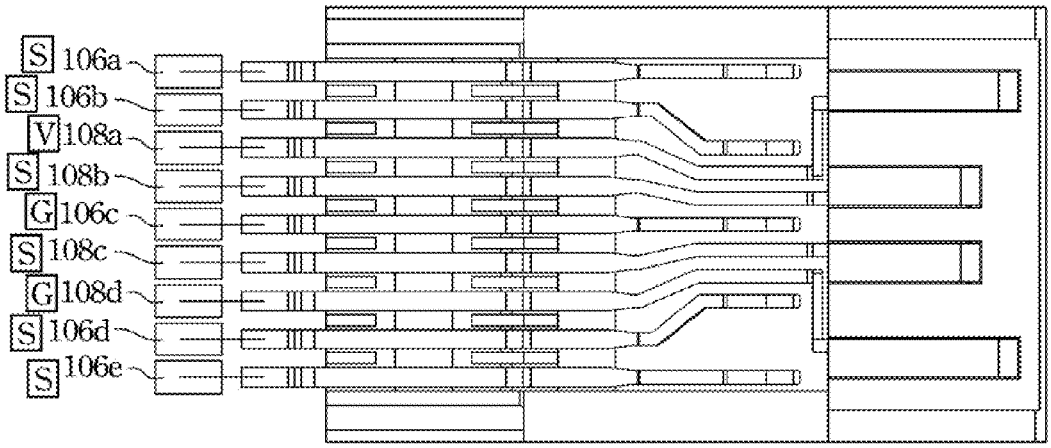
FIG. 5 illustrates the USB connector plug as illustrated in FIG. 4 with its contacts connected to a circuit board's solder pads.

FIG. 3 illustrates the USB connector plug as illustrated in FIG. 1 with its housing removed. FIG. 4 illustrates a top view of the USB connector plug as illustrated in FIG. 3. FIG. 5 illustrates the USB connector plug as illustrated in FIG. 4 with its contacts connected to a circuit board's solder pads. The USB 3.0 contact array includes two signal differential pairs and a ground contact 106*c*. Signal contacts (106*a*, 106*b*) are of one signal differential pair while signal contacts (106*d*, 106*e*) are of the other signal differential pair. The USB 2.0 contact array includes a signal differential pair (108*b*, 108*c*), a power contact 108*a* and a ground contact 108*d*. All the contacts are partially located within their respective grooves 102*a* of the dielectric base 102 such that they can be electrically insulated from one another. In the drawings of disclosures herein, each signal differential pair (or signal contact) is labeled with S, each power contact is labeled with V and each ground contact is labeled with G.

FIG. 5 illustrates the USB connector plug as illustrated in FIG. 4 with its contacts connected to a circuit board's solder pads. The signal differential pair (108*b*, 108*c*) is located between the signal differential pair (106*a*, 106*b*) and signal differential pair (106*d*, 106*e*). The power contact 108*a* is located between the signal differential pair (106*a*, 106*b*) and signal differential pair (108*b*, 108*c*). The ground contact 108*d* is located between the signal differential pair (106*d*, 106*e*) and signal differential pair (108*b*, 108*c*). From an overview, the contact array is arranged as S, S, V, S, G, S, G, S, S along a line.

Referring again to FIG. 5, the USB 3.0 signal differential pair (106*a*, 106*b*) has its two signal contacts adjacent to each other, and no power contact or ground contact is located therebetween. The USB 3.0 signal differential pair (106*d*, 106*e*) also has its two signal contacts adjacent to each other, and no power contact or ground contact is located therebetween. No power contact or ground contact located between a signal differential pair would reduce cross talks to the least, which is especially important for high-speed signal transferring of USB 3.0 specification.

Figure 6:
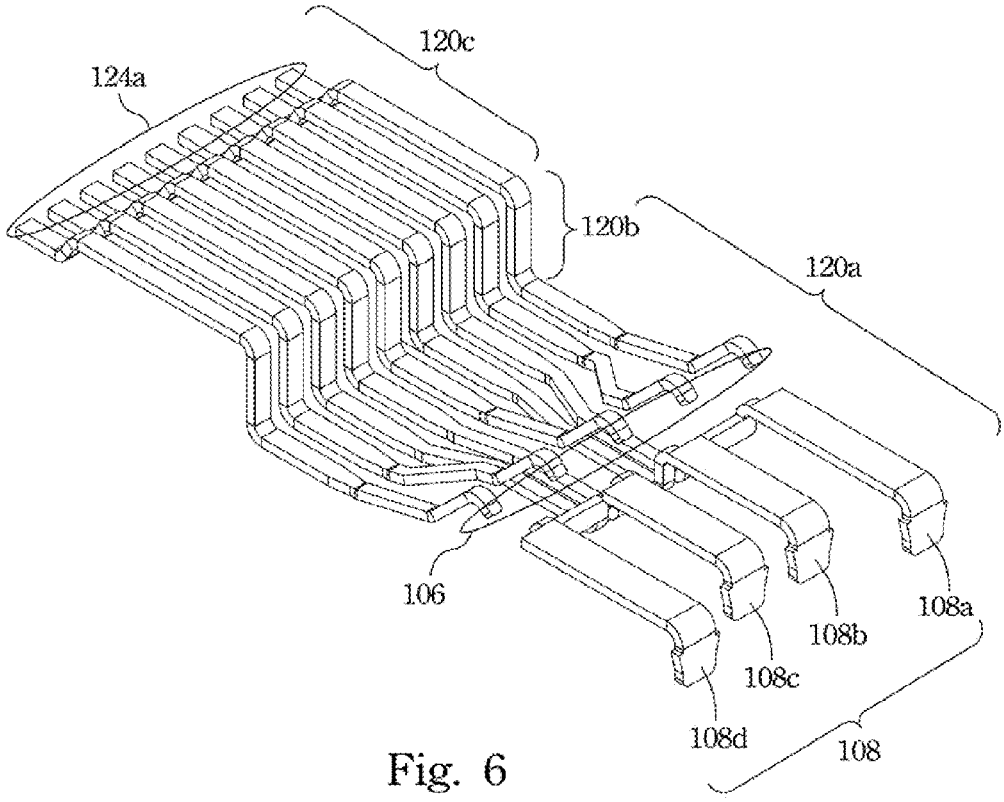
FIG. 6 illustrates a contact array of the USB connector plug according to one embodiment of this invention.
Figure 7:
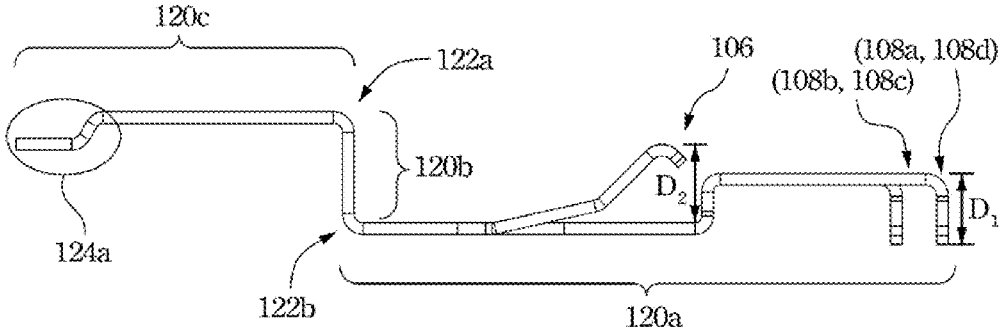
FIG. 7 illustrates a side view of the contact array as illustrated in FIG. 6.

FIG. 6 illustrates a contact array of the USB connector plug according to one embodiment of this invention. FIG. 7 illustrates a side view of the contact array as illustrated in FIG. 6. The contact array, as illustrated in FIG. 6 and FIG. 7, is the USB connector plug of FIG. 3 with the dielectric base 102 removed. Each contact is divided into three sections: a front terminal section 120*a*, a middle section 120*b* and a rear terminal section 120*c*. The middle section 120*b* is interconnected between the front terminal section 120*a* and the rear terminal section 120*c*. The front terminal section 120*a* is operable to connect with a corresponding USB connector receptacle, whereas the rear terminal section 120*c* is operable to connect with a printed circuit board. A bent section 122*b* is interconnected between the middle section 120*b* and the front terminal section 120*a*, whereas a bent section 122*a* is interconnected between the middle section 120*b* and the rear terminal section 120*c*.

The rear terminal section 120*c* of each contact has its end to be connected with a printed circuit board (not illustrated in the drawings). In this embodiment, the end of the rear terminal section 120*c* is a SMT (Surface Mounting Technology) terminal.

The front terminal section 120*a* of each contact has its end to be connected with a corresponding USB connector receptacle (not illustrated in the drawings). In order to satisfy USB 3.0 specifications and above-mentioned design requirements, the front terminal section 120*a* has various bent section designs as discussed below.

Referring both to FIG. 4 and FIG. 6, the front terminal section 120*a* of the signal contact 106*b* is bent several times to have its end being closer to the signal differential pair (108*b*, 108*c*) than the middle section 120*b* of the signal contact 106*b* is. The front terminal section 120*a* of the signal contact 106*d* is bent several times to have its end being closer to the signal differential pair (108*b*, 108*c*) than the middle section 120*b* of the signal contact 106*d* is. The front terminal section 120*a* of the power contact 108*a* is bent several times to have its end being farther from the signal differential pair (108*b*, 108*c*) than the middle section 120*b* of the power contact 108*a* is. The front terminal section 120*a* of the ground contact 108*d* is bent several times to have its end being farther from the signal differential pair (108*b*, 108*c*) than the middle section 120*b* of the ground contact 108*d* is. By the bent designs of the contact array, the end of the front terminal section 120*a* of the ground contact 108*d* is located between the ends of the front terminal section 120*a* of the signal differential pair (106*a*, 106*b*) when being viewed from the front terminal section 120*a* thereof towards the rear terminal section 120*c* thereof, and the end of the front terminal section 120*a* of the power contact 108*a* is located between the ends of the front terminal section 120*a* of the signal differential pair (106*d*, 106*e*) when being viewed from the front terminal section 120*a* thereof towards the rear terminal section 120*c* thereof. Therefore, USB 3.0 specification can be satisfied.

Referring again to FIG. 7, the bent sections (122*a*, 122*b*) are generally right-angled sections in this embodiment. In an alternate embodiment, the bent sections (122*a*, 122*b*) can be otherwise bent, i.e. not right-angled, along a surface profile of the dielectric base 102. Besides, the front terminal section 120*a* of the contact array 106 is bent upward to have a maximum interval $D_1$. The front terminal section 120*a* of the contact array 106 is also bent upward and down to have a maximum interval $D_2$. Of the contact array 108, the contacts (108*a*, 108*b*) are longer than the contacts (108*c*, 108*d*).

Figure 8:
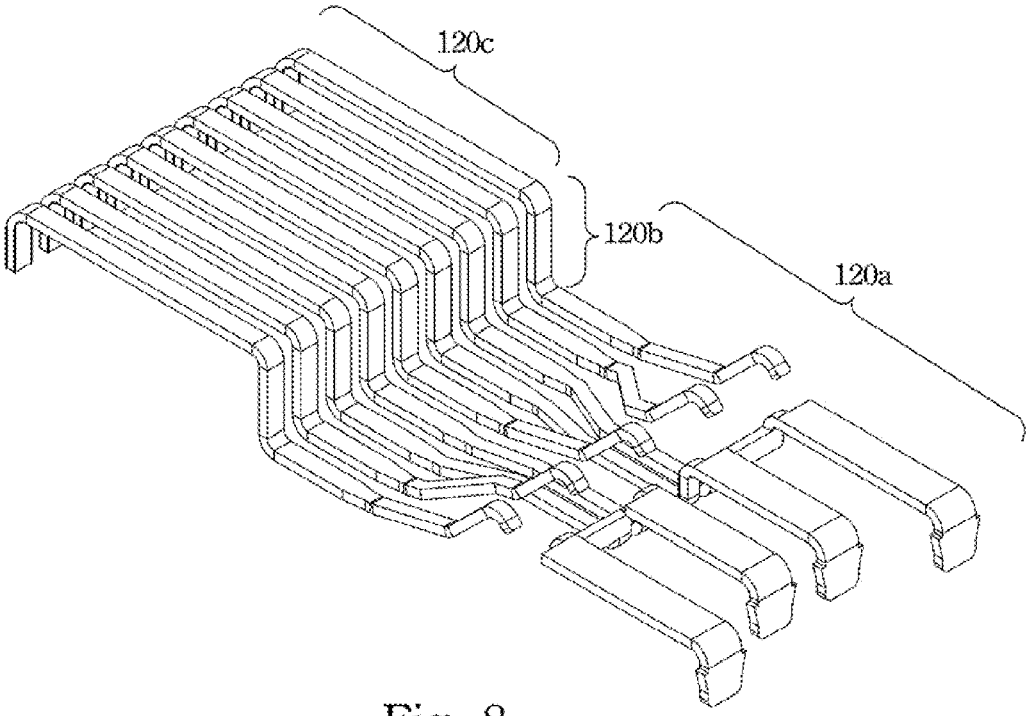
FIG. 8 illustrates a contact array of the USB connector plug according to another embodiment of this invention.
Figure 9:
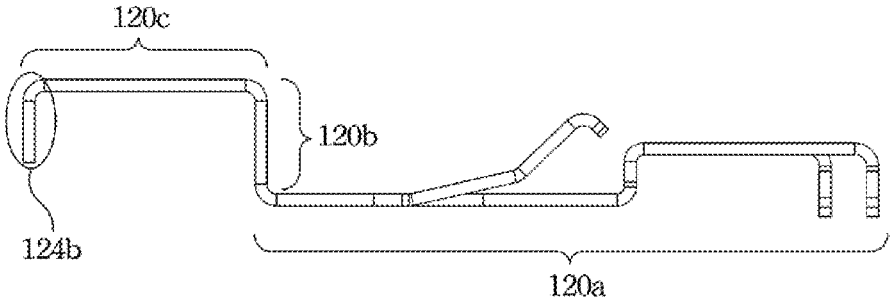
FIG. 9 illustrates a side view of the contact array as illustrated in FIG. 8.

FIG. 8 illustrates a contact array of the USB connector plug according to another embodiment of this invention. FIG. 9 illustrates a side view of the contact array as illustrated in FIG.

8. This embodiment differs from FIG. 6 and FIG. 7 in that the rear terminal section 120*c* has a different terminal type. In this embodiment, the rear terminal section 120 has a DIP (Dual In-line Package) terminal 124*b*.

Figure 10:
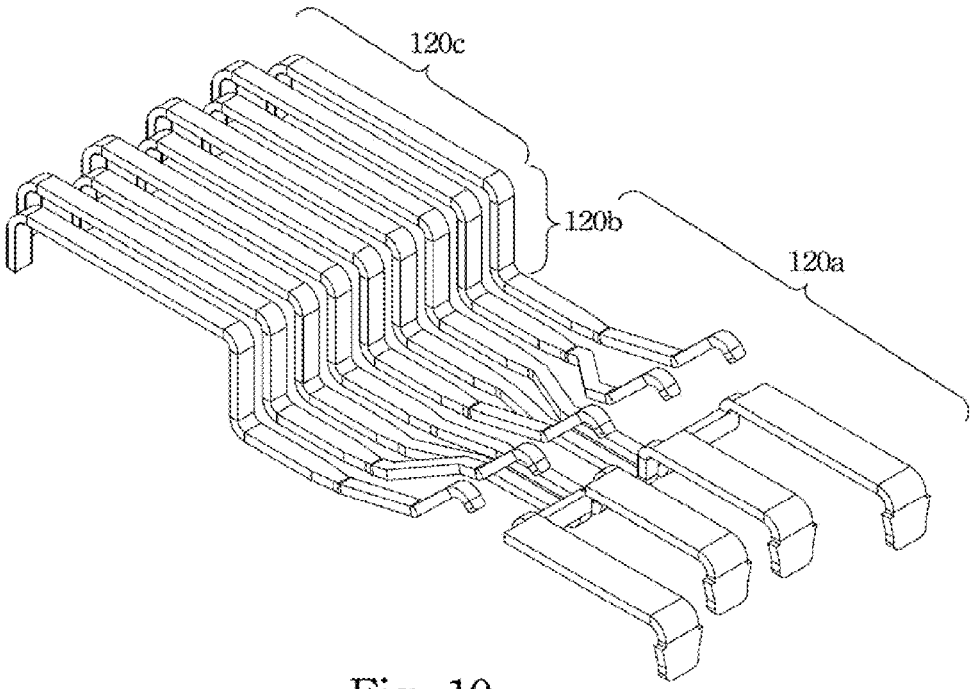
FIG. 10 illustrates a contact array of the USB connector plug according to still another embodiment of this invention.
Figure 11:
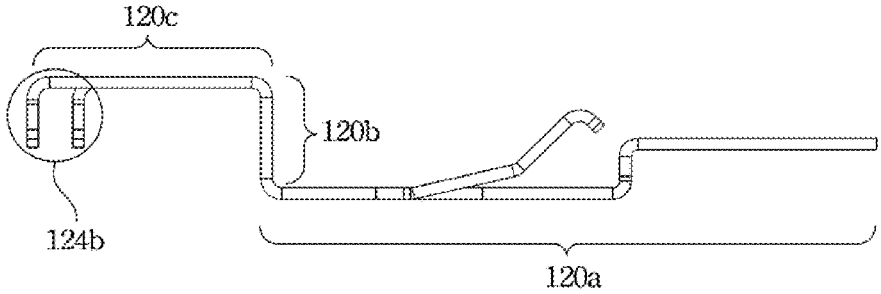
FIG. 11 illustrates a side view of the contact array as illustrated in FIG. 10.

FIG. 10 illustrates a contact array of the USB connector plug according to still another embodiment of this invention. FIG. 11 illustrates a side view of the contact array as illustrated in FIG. 10. This embodiment differs from FIG. 8 and FIG. 9 in that the rear terminal section 120*c* has a different terminal arrangement. In this embodiment, the rear terminal section 120*c* has its adjacent DIP terminals 124*b* of different lengths. When the DIP terminals 124*b* are soldered to a printed circuit board, adjacent DIP terminals 124*b* of different lengths would make the interval between solder pads longer such that cross talks can be reduced. The same terminal arrangements can be applied on the embodiments of FIG. 6 and FIG. 7.

Figure 12:
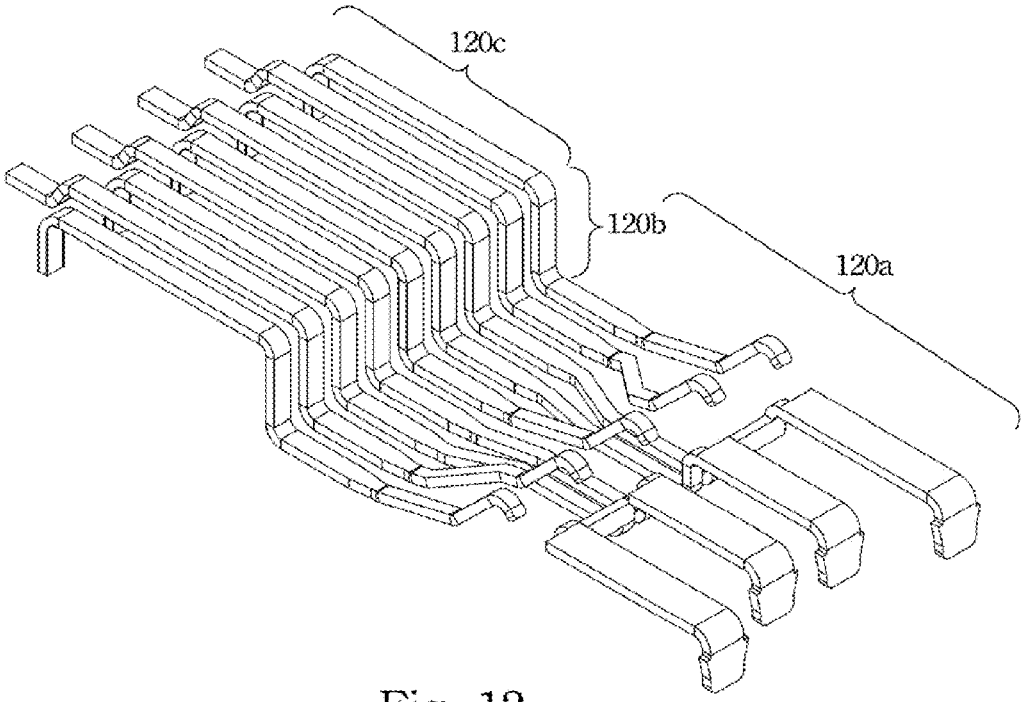
FIG. 12 illustrates a contact array of the USB connector plug according to yet another embodiment of this invention.
Figure 13:
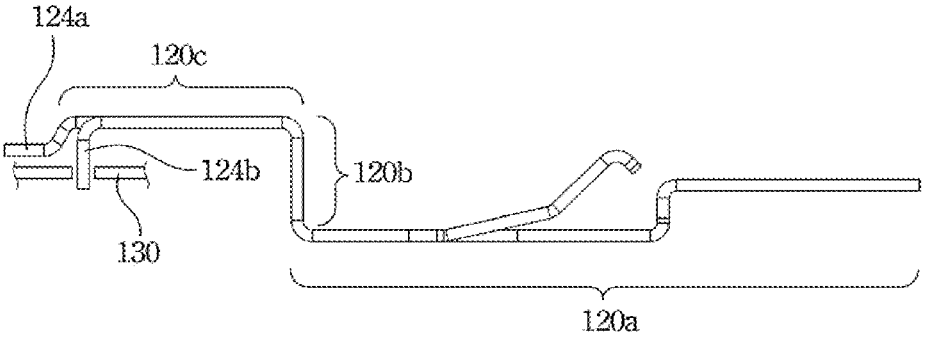
FIG. 13 illustrates a side view of the contact array as illustrated in FIG. 12.

FIG. 12 illustrates a contact array of the USB connector plug according to yet another embodiment of this invention. FIG. 13 illustrates a side view of the contact array as illustrated in FIG. 12. This embodiment differs from the foregoing embodiments in that the rear terminal section 120*c* has different terminal arrangements and different terminal types. In this embodiment, the SMT terminals 124*a* and DIP terminals 124*b* are alternately arranged. The SMT terminals 124*a* are soldered on a surface of a printed circuit board 130, whereas the DIP terminals I 24*b* are soldered within a through hole of the printed circuit board 130.

Figure 14:
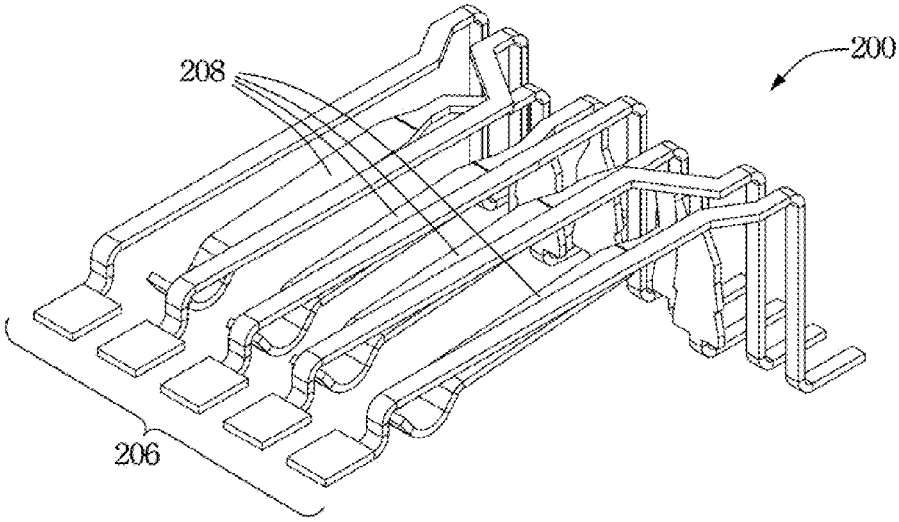
FIG. 14 illustrates a contact array of the USB connector receptacle according to one embodiment of this invention.

FIG. 14 illustrates a contact array of the USB connector receptacle according to one embodiment of this invention. In order to reduce cross talks among the contact array, the USB connector receptacle has a similar design on the contact array as in the USB connector plug. The contact array 200 includes a USB 2.0 contact array 208 and a USB 3.0 contact array 206 such that the USB connector plug 100 can be compatible with a USB 2.0 connector plug.

Figure 15:
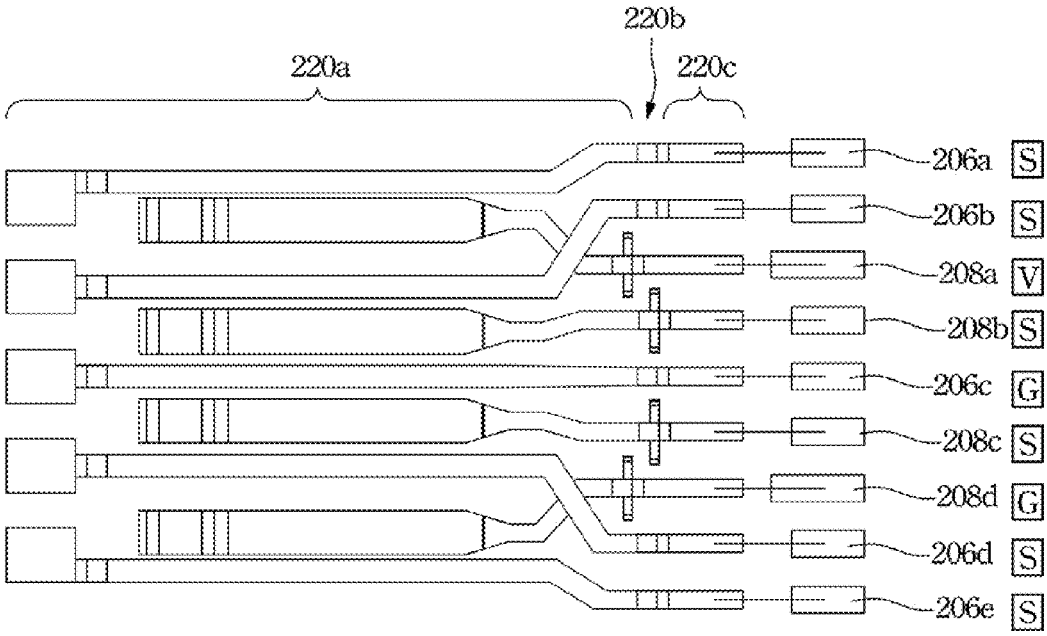
FIG. 15 illustrates a top view of the contact array as illustrated in FIG. 14 with its contacts connected to a circuit board's solder pads.

FIG. 15 illustrates a top view of the contact array as illustrated in FIG. 14 with its contacts connected to a circuit board's solder pads. The USB 3.0 contact array includes two signal differential pairs and a ground contact 206*c*. Signal contacts (206*a*, 206*b*) are of one signal differential pair while signal contacts (206*d*, 206*e*) are of the other signal differential pair. The USB 2.0 contact array includes a signal differential pair (208*b*, 208*c*), a power contact 208*a* and a ground contact 208*d*.

When the foregoing contact array has its rear terminal section 220*c* connected with a printed circuit board, the arrangements of the contact array are detailed below. The signal differential pair (208*b*, 208*c*) is located between the signal differential pair (206*a*, 206*b*) and signal differential pair (206*d*, 206*e*). The power contact 208*a* is located between the signal differential pair (206*a*, 206*b*) and the signal differential pair (208*b*, 208*c*). The ground contact 208*d* is located between the signal differential pair (206*d*, 206*e*) and the signal differential pair (108*b*, 108*c*). From an overview, the contact array is arranged as S, S, V, S, G, S, G, S, S along a line.

The USB 3.0 signal differential pair (206*a*, 206*b*) has its two signal contacts adjacent to each other, and no power contact or ground contact is located therebetween. The USB 3.0 signal differential pair (206*d*, 206*e*) also has its two signal contacts adjacent to each other, and no power contact or ground contact is located therebetween. No power contact or ground contact located between a signal differential pair would reduce cross talks to the least, which is especially important for high-speed signal transferring of USB 3.0 specification.

Figure 16:
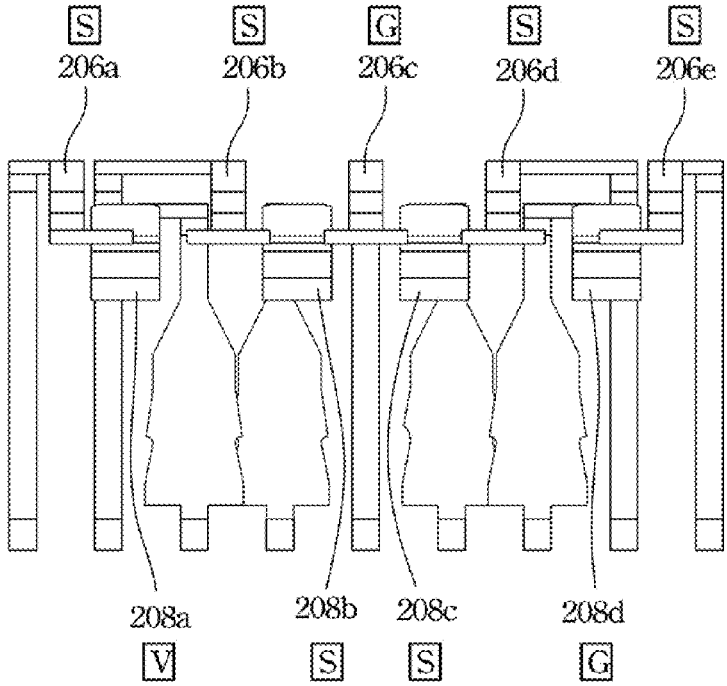
FIG. 16 illustrates a front view of the contact array as illustrated in FIG. 14.
Figure 17:
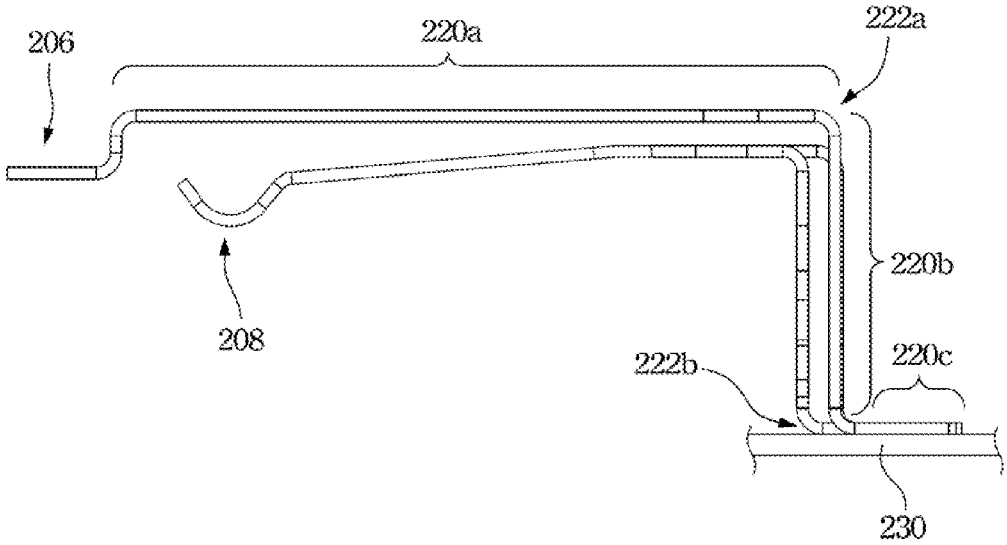
FIG. 17 illustrates a side view of the contact array as illustrated in FIG. 14.

FIG. 16 illustrates a front view of the contact array as illustrated in FIG. 14. FIG. 17 illustrates a side view of the contact array as illustrated in FIG. 14. Each contact is divided into three sections: a front terminal section 220*a*, a middle section 220*b* and a rear terminal section 220*c*. The middle section 220*b* is interconnected between the front terminal section 220*a* and the rear terminal section 220*c*. The front terminal section 220*a* is operable to connect with a corresponding USB connector plug, whereas the rear terminal section 220*c* is operable to connect with a printed circuit board 230. A bent section 222*a* is interconnected between the middle section 220*b* and the front section 220*a*, whereas a bent section 222*b* is interconnected between the middle section 220*b* and the rear terminal section 220*c*. In this embodiment, the rear terminal section 220*c* includes a SMT terminal. In an alternate embodiment, the rear terminal section 220*c* may include a DIP terminal (as illustrated in FIG. 8), or SMT terminals and DIP terminals arranged alternately (as illustrated in FIG. 12).

The front terminal section 220*a* of each contact has its end to be connected with a corresponding USB connector plug (not illustrated in the drawings). In order to satisfy USB 3.0 specifications and above-mentioned design requirements, the front terminal section 220*a* has various bent section designs as discussed below.

Referring both to FIG. 15 and FIG. 17, the front terminal section 220*a* of the signal contact 206*b* is bent several times to have its end being closer to the signal differential pair (208*b*, 208*c*) than the middle section 220*b* of the signal contact 206*b* is. The front terminal section 220*a* of the signal contact 206*d* is bent several times to have its end being closer to the signal differential pair (208*b*, 208*c*) than the middle section 220*b* of the signal contact 206*d* is. The front terminal section 220*a* of the power contact 208*a* is bent several times to have its end being farther from the signal differential pair (208*b*, 208*c*) than the middle section 220*b* of the power contact 208*a* is. The front terminal section 220*a* of the ground contact 208*d* is bent several times to have its end being farther from the signal differential pair (208*b*, 22108*c*) than the middle section 220*b* of the ground contact 208*d* is. Therefore, USB 3.0 specification can be satisfied.

According to foregoing discussed embodiments, the contact array's arrangements of the USB connector's plug or receptacle would improve signal transferring efficiency and reduce cross talks among the array contacts, which is especially important for high-speed, high-frequency signal transferring of USB 3.0 specification in connection with a printed circuit board.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A contact array of a universal serial bus (USB) connector comprising a first signal differential pair, a second signal differential pair and a third signal differential pair, wherein the second signal differential pair is disposed between the first and third signal differential pairs, and at least one power contact is disposed between the first and second signal differential pairs, and at least one ground contact is disposed between the second and third signal differential pairs.

2. The contact array of claim 1, wherein the first and third signal differential pairs are USB 3.0 signal differential pairs.

3. The contact array of claim 2, wherein the second signal differential pair is a USB 2.0 signal differential pair.

4. The contact array of claim 3, further comprising a USB 3.0 ground contact disposed between the second signal differential pair.

5. The contact array of claim 1, wherein the power contact is a USB 2.0 power contact, and the ground contact is a USB 2.0 ground contact.

6. The contact array of claim 5, wherein the first signal differential pair comprises a first signal contact and a second signal contact, the second signal contact is closer to the second signal differential pair than the first signal contact is, the third signal differential pair comprises a third signal contact and a fourth signal contact, the third signal contact is closer to the second signal differential pair than the fourth signal contact is.

7. The contact array of claim 6, wherein each of the signal, power or ground contacts comprises a middle section and two opposite first terminal section and second terminal section, the middle section is interconnected between the first terminal section and second terminal section, the first terminal section is operable to connect with a corresponding USB connector, the second terminal section is operable to connect with a printed circuit board.

8. The contact array of claim 7, wherein the first terminal section of the second signal contact is bent to have an end thereof closer to the second differential pair than the middle section of the second signal contact is, the first terminal section of the third signal contact is bent to have an end thereof closer to the second differential pair than the middle section of the third signal contact is.

9. The contact array of claim 8, wherein the first terminal section of the USB 2.0 power contact is bent to have an end thereof farther from the second differential pair than the middle section of the USB 2.0 power contact is, the first terminal section of the USB 2.0 ground contact is bent to have an end thereof farther from the second differential pair than the middle section of the USB 2.0 ground contact is.

10. The contact array of claim 9, wherein the end of the first terminal section of the USB 2.0 ground contact is disposed between the ends of the first terminal section of the first and second signal contacts when being viewed from the first terminal section thereof towards the second terminal section thereof, and the end of the first terminal section of the USB 2.0 power contact is disposed between the ends of the first terminal section of the third and fourth signal contacts when being viewed from the first terminal section thereof towards the second terminal section thereof.

11. A contact array of a universal serial bus (BUS) connector comprising:

a plurality of contacts each comprising a middle section, a first terminal section and a second terminal section, the middle section being interconnected between the first terminal section and second terminal section, a first bent section being interconnected between the first terminal section and the middle section, a second bent portion being interconnected between the second terminal section and the middle section, wherein the contacts comprises:

a first signal differential pair, a second signal differential pair and a third signal differential pair, wherein the second signal differential pair is disposed between the first and third signal differential pairs, and at least one power contact is disposed between the first and second signal differential pairs, and at least one ground contact is disposed between the second and third signal differential pairs.

12. The contact array of claim 11, wherein the first bent section is generally a right-angled section, and the second bent section is generally a right-angled section.

13. The contact array of claim 11, wherein the first terminal section is operable to connect with a corresponding USB connector, the second terminal section is operable to connect with a printed circuit board.

14. The contact array of claim 13, wherein the second terminal section of the contacts comprises SMT terminals.

15. The contact array of claim 13, wherein the second terminal section of the contacts comprises DIP terminals.

16. The contact array of claim 13, wherein the second terminal section of the contacts comprises SMT terminals and DIP terminals.

17. The contact array of claim 16, wherein the SMT terminals and DIP terminals are alternately arranged.

18. A universal serial bus (USB) connector comprising:

a metallic housing;

a dielectric base disposed within the metallic housing and comprising a plurality of grooves spaced apart from one another; and a plurality of contacts each disposed respectively within the plurality of grooves, wherein the contacts comprises:

a first signal differential pair, a second signal differential pair and a third signal differential pair, wherein the second signal differential pair is disposed between the first and third signal differential pairs, and at least one power contact is disposed between the first and second signal differential pairs, and at least one ground contact is disposed between the second and third signal differential pairs.

19. A contact array of a universal serial bus (USB) connector comprising a first signal differential pair, a second signal differential pair and a third signal differential pair, the signal differential pairs each comprising a terminal section, to which a printed circuit board is connected, wherein the terminal sections of the signal differential pairs comprises are arranged as:

the second signal differential pair is disposed between the first and third signal differential pairs, and at least one power contact is disposed between the first and second signal differential pairs, and at least one ground contact is disposed is disposed between the second and third signal differential pairs.

20. The contact array of claim 19, wherein the first signal differential pair comprises a first signal contact and a second signal contact, the second signal contact is closer to the second signal differential pair than the first signal contact is, the third signal differential pair comprises a third signal contact and a fourth signal contact, the third signal contact is closer to the second signal differential pair than the fourth signal contact is.

* * * * *